United States Patent [19]

Suchsland et al.

[11] 4,066,029

[45] Jan. 3, 1978

[54] ELECTROMECHANICAL REMOTE CAM SELECTOR FOR SEWING MACHINES

[75] Inventors: Alfred R. Suchsland, Morris Plains; Terry L. Wilson, Parsippany, both of N.J.

[73] Assignee: The Singer Company, New York, N.Y.

[21] Appl. No.: 648,077

[22] Filed: Jan. 12, 1976

[51] Int. Cl.[2] ..... D05B 3/02

[52] U.S. Cl. ..... 112/158 E

[58] Field of Search ..... 112/158 E, 158 C, 158 A, 112/158 B, 158 R

[56] References Cited

U.S. PATENT DOCUMENTS

| | | | |
|---|---|---|---|
| 3,699,910 | 10/1972 | Uricola | 112/158 A |
| 3,874,312 | 4/1975 | Cook et al. | 112/158 C |
| 3,929,081 | 12/1975 | Ketterer | 112/158 E X |

*Primary Examiner*—Werner H. Schroeder
*Assistant Examiner*—Peter Nerbun
*Attorney, Agent, or Firm*—William V. Ebs; Edward L. Bell; Robert E. Smith

[57] ABSTRACT

This disclosure relates to an electromagnetic selector system for selecting pattern cams in a sewing machine wherein operator influenced electric pattern selection switches are provided with each said switch corresponding to a pattern on a pattern cam. An adder mechanism is responsive to switch selection for positioning a pattern cam follower in order to transmit the pattern information from the pattern cam to the appropriate sewing instrumentality for reproducing the selected pattern.

16 Claims, 5 Drawing Figures

BINARY SELECTION CHART

| SWITCH | SOLENOID | CAM | FOLLOWER MOVEMENT INCHES |
|---|---|---|---|
| SWITCH 92a | SOLENOID 108 | CAM 66a | 0 |
| SWITCH 92b | SOLENOID 88a & 108 | CAM 66b | .125 |
| SWITCH 92c | SOLENOID 88b & 108 | CAM 66c | .250 |
| SWITCH 92d | SOLENOID 88c & 108 | CAM 66d | .375 |
| SWITCH 92e | SOLENOID 88a, 88c & 108 | CAM 66e | .500 |
| SWITCH 92f | SOLENOID 88b, 88c & 108 | CAM 66f | .625 |
| SWITCH 92g | SOLENOID 88a, 88b, 88c & 108 | CAM 66g | .750 |

ELECTROMECHANICAL REMOTE CAM SELECTOR FOR SEWING MACHINES

BACKGROUND OF THE INVENTION

It is known in the sewing machine art to provide a plurality of pattern cams having pattern information thereon in order to reproduce ornamental stitching in a fabric. Such pattern cams are generally read by mechanical cam followers which are selected individually by relatively complicated mechanical mechanisms for transmitting the pattern information from the pattern cam to the various sewing instrumentalities. Other mechanisms have recently become known in the prior art for providing ornamental stitching such as the adder type mechanism shown in U.S. Pat. No. 3,812,729 and the electronic memory-type system as illustrated in U.S. Pat. No. 3,872,808. There have also been other proposals for providing means to electromagnetically select individual pattern cams in accordance with a manually operable switch means such as illustrated in U.S. Pat. No. 3,874,312. The prior art cited in the latter mentioned U.S. patent also shows that it has been known in the art to provide electromagnetic means for cam selection of various types. In accordance with the present invention an electromagnetic cam selection means is provided wherein movement of a cam follower is initiated to a cam selection position by an adder mechanism which in turn is activated by an operator influenced manually operated electric switch means. The switch means is also operative for selecting a pattern from a pattern cam corresponding to the pattern selected by the switch means. The present invention has one advantage in that it may be incorporated into known type mechanical pattern cam machines having a single follower by adding the mechanism of the present invention, as will be understood hereinafter, without completely requiring a major conversion of the pattern mechanism of the machine. Further, as will also be apparent hereinafter, the adder mechanism of the machine is really simple in construction having relatively few moving parts which move only during pattern selection thereby eliminating the problems of wearing of parts and noise which was present in some of the prior art type adder mechanisms.

SUMMARY OF THE INVENTION

In accordance with the preferred embodiment of the present invention, a cam stack having a plurality of pattern cams is provided along with a single cam follower for reading the patterns from the pattern cams in a similar manner to that which is known in prior pattern cam sewing machines. In order to select a desired pattern cam, a binary adder mechanism is provided which comprises a plurality of pairs of relatively movable substantially wedge-shaped elements, movement of one of the movable elements of which being initiated by solenoid mechanisms associated therewith. The solenoid mechanisms are operatively associated with switch means for selecting appropriate initiation of movement of one or more pairs of binary adder elements to move the pattern follower to an appropriate pattern cam which corresponds to the pattern selected by the switch means. An override cam and follower are also provided and which are operative for only a short period of time and which are adapted for facilitating the relatively rapid movement of the pattern cam followers into engagement with the appropriate pattern cam.

Accordingly, it is one object of the invention to provide a novel and improved electromagnetic pattern cam selecting mechanism for a sewing machine.

It is a further object of the invention to provide a novel and improved electromagnetic cam selector mechanism for a sewing machine including a binary adder mechanism for initiating appropriate movement of the pattern cam follower in relation to the pattern cam elements.

It is an additional object of the invention to provide a novel and improved pattern cam selecting mechanism for a sewing machine wherein in response to selection of an electric switch a pattern cam will be selected for reproducing an ornamental pattern corresponding to the electric switch selection.

Other objects and advantages of the invention will be best understood when reading the following detailed description of a preferred embodiment of the invention with the accompanying drawings in which:

DETAILED DESCRIPTION OF THE PREFERRED EMBODIMENT

Figure 1:
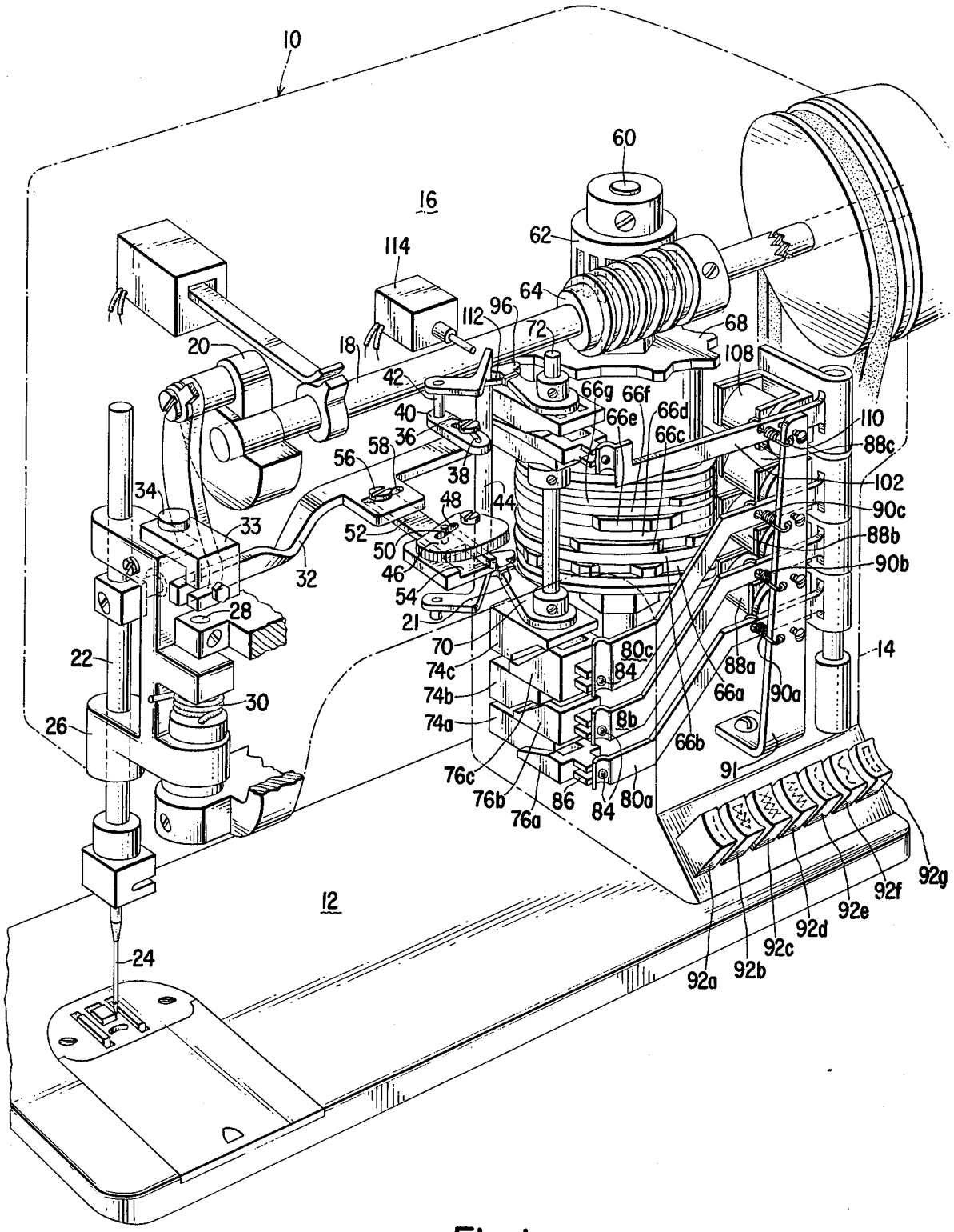
FIG. 1 is a perspective view of a sewing machine with portions of the frame illustrated in phantom lines and illustrating the invention as applied thereto.

With reference to FIG. 1, the invention is illustrated therein as being incorporated into the pattern cam mechanism of a sewing machine for influencing the lateral jogging motion of the needle in producing zigzag or other ornamental stitching. It will be understood however that the invention could be applied to other sewing instrumentalities of the invention such as the feed or other fabric moving type mechanisms. As illustrated, the sewing machine includes a frame 10 having a bed 12 from which rises a standard 14 supporting a bracket arm 16 overhanging the bed. An arm shaft 18 is journalled in the bracket arm and carries a crank 20 connected by suitable linkage to needle bar 22 for imparting endwise reciprocatory movement to said needle bar. The needle bar 22 is provided with a thread carrying needle 24 affixed to its terminal end thereof. The needle bar 22 is slidably supported in a gate 26 which may oscillate on a pivot pin 28 carried on the bracket arm so that lateral jogging movement may be imparted to the needle. A spring 30 serves to bias the gate 26 in a clockwise direction as viewed in FIG. 1 and the lateral position of the gate in opposition to the spring is influenced by a drive link 32 secured to bracket 33 which is pivoted to the gate as at 34. The drive link 32 carries a pivot pin 36 at its other extremity which is accommodated in a radial slot 38 formed in a rock arm 40 which is fixed to rock shaft 42 journalled in the bracket arm 13. The rock shaft 42 also has fixed thereon a wobble plate 44.

A dial 46 is provided in bracket arm for adjusting the amplitude of the jogging of the needle bar or the bight and is pivoted about a pivot pin as illustrated. The adjusting dial 46 includes a radial slot 48 embracing a pin 50 extending from a connecting slide 52 which is slidably constrained in a guide slot 54 in the bracket arm and carries a pin 56 accommodated in a slot 58 formed lengthwise in the drive link 32. By this arrangement, adjustment or turning of the dial 46 serves to shift the pivot pin 36 on the drive link 32 along the slot 38 to control the width of zig-zag movements imparted to the needle bar.

A cam shaft 60 is journalled in the bracket arm and carries a worm gear 62 drivingly engaging a worm 64 on the arm shaft. A plurality of pattern cams 66*a, b, c, d, e, f* and *g* are carried in stacked relationship on the cam shaft as well as a special cam 68 whose function will be described in greater detail hereinafter. As is known in the art, each of the pattern cams 66*a – g* is provided with an individual cam track thereon which represents an individual ornamental pattern. In order to transmit the pattern informtion from the pattern cam into ornamental stitching, a pattern cam follower 70, which is connected to the wobble plate 44 by means of a spring clip 71 but in sliding relationship therewith, is provided for reading the information from the pattern cam and transmitting it to the wobble plate 44. Vary briefly, as motion is transmitted from the pattern cam through the pattern cam follower 70 to the wobble plate 44, the wobble plate is caused to rock along with its shaft 42 to which it is fixed thus causing the rock arm 40 to swing carrying with it the drive link 32 for initiating jogging movement of the needle bar gate 26 in accordance with the degree of movement initiated by the cam follower 70.

Figure 2A:
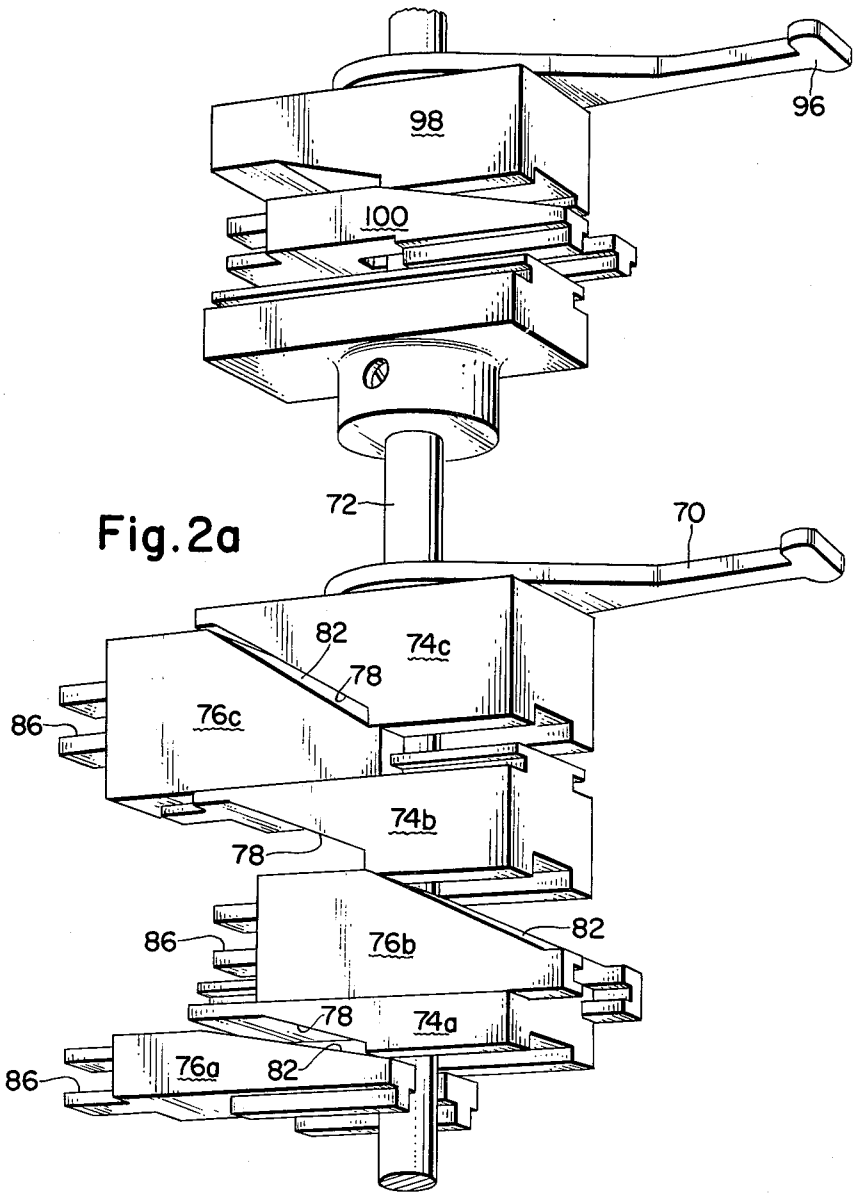
FIG. 2*a* is an enlarged view of the adder mechanism shown in one operative position.
Figure 2:
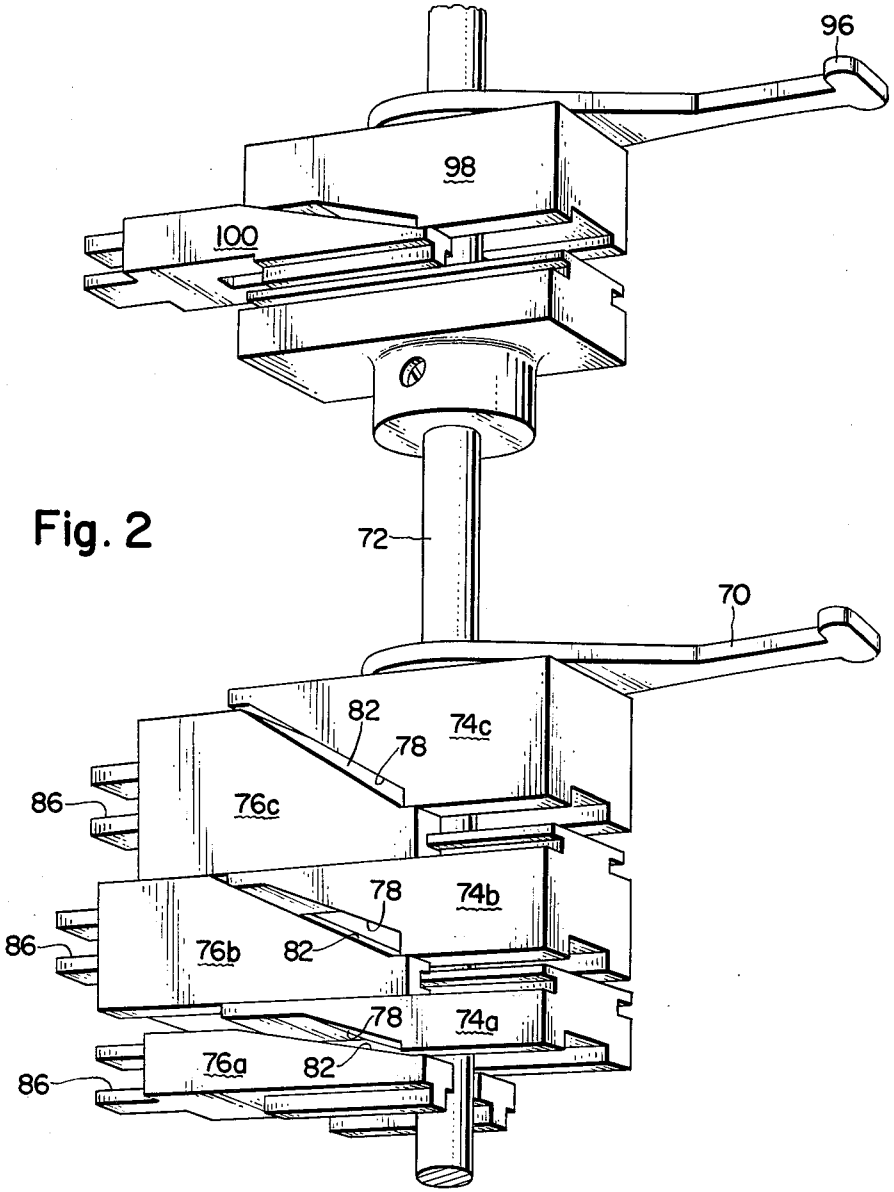
FIG. 2 is an enlarged view of the adder mechanism of the invention.

In order to initiate movement of the pattern cam follower 70 relative to the individual pattern cams 66*a – g* for selection of one of said cams, an adder mechanism is provided which is operative in association with an electric switch means influenced by the operator, as will be more fully described hereinafter. Referring again to FIG. 1, it will be seen that the cam follower 70 is supported on a shaft 72 which shaft 72 is suitably supported in the bracket arm 16. The cam follower 70 is mounted on the shaft 72 so that it is rotatable relative thereto and is capable of movement in a linear direction relative to the axis of the shaft 72. Also supported on shaft 72 for linear movement relative to the axis thereof are a plurality of movable adder elements 74*a, b* and *c* which as illustrated in FIGS. 2 and 2*a* have a substantially wedge-shape configuration including a cam surface 78. Supported intermediate each of the adders 74*a – c* are movable adder elements 76*a, b* and *c*, each of which is supported on an associated link member 80*a, b* and *c* for movement perpendicular to the axis of the adder shaft 72 for selective operative engagement with the adders 74*a – c*. As also will be seen in FIGS. 2 and 2*a* each of the adders 76*a – c* has a cam surface 82 which is disposed for camming engagement with the cam surface 78 on the adders 74*a – c*. Each of the link members 80*a – c* carries a pin 84 for disposition in a slot 86 in each of the adders 76*a – c* as shown in FIG. 1, so that movement toward and away from the axis of the adder shaft 72 may be initiated by the links 80*a – c* while permitting movement of the slider adders in a direction along the axis of the shaft 72 relative to the link members due to the length of the slots 86 on said link members 80*a – c*.

Each of the link members 80*a – c* is formed of a relatively rigid material and is connected at its opposite end to associated solenoids 88*a, b* and *c*. The solenoids 88*a – c* are operative so that when each is turned on its plunger will be drawn inwardly toward the body of the solenoid to move its associated link members 80*a – c* in a direction toward the shaft 72 thus carrying its associated adder members 76*a – c* into camming engagement with its associated adder members 74*a – c*. Spring members 90*a, b* and *c* are connected to each link members 80*a – c* and to a bracket member 91 suitably fixed to the frame for returning the link members to their inoperative position when the associated solenoid is turned off.

Figures 3, 4:
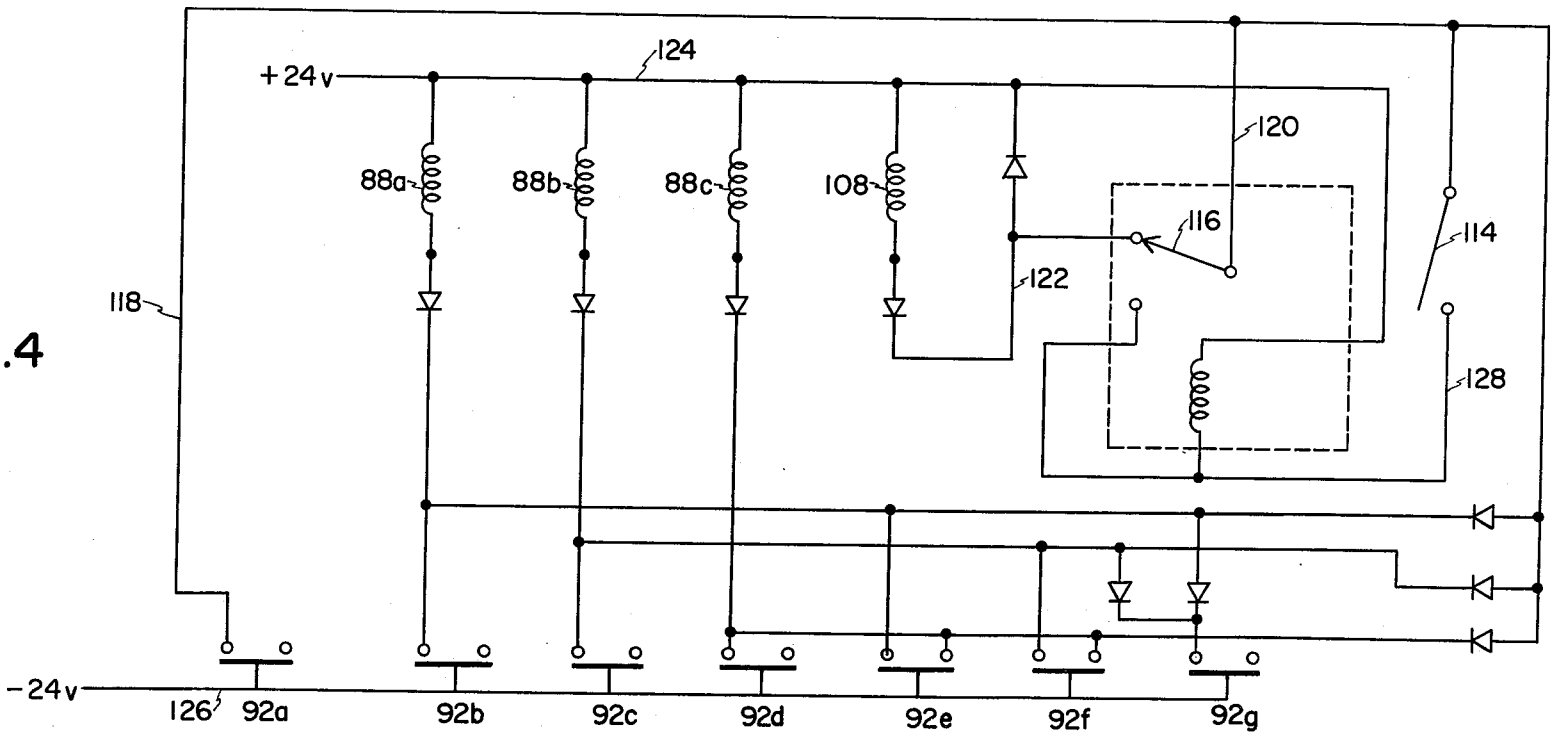
FIG. 3 is a chart illustrating the various combinations of selections which may be made from the binary adder mechanism.
FIG. 4 is a circuit diagram showing an electrical arrangement suitable for operating the pattern cam selection mechanism of the invention.

Further with reference to FIGS. 1 and 4, a plurality of manually operable electric switches, there being seven illustrated in FIG. 1, are supported in the standard 14 and as illustrated in FIG. 4 are connected to the solenoids 88*a – c*. The switches 92*a, b, c, d, e, f* and *g* each represent a separate and individual ornamental pattern which can be selected by the pattern selection mechanism. When an individual switch is selected and depressed by the operator, a particular solenoid or combination of solenoids will be actuated for initiating movement of their associated adders 76*a – c* into camming engagement with the adders 74*a – c* associated therewith for initiating linear movement in a vertical direction along the axis of the shaft 72 of said adder 74*a – c*. As will be apparent, such linear movement of the adders will initiate movement of the cam follower to a distance corresponding to the linear movement of one or more of the linear adders 74*a – c*. As will be apparent hereinafter, this movement is predetermined so that the cam follower will be positioned adjacent a pattern cam 66*a – g* which corresponds to the pattern represented by the switch selected by the operator. The predetermined motion of the adder mechanism for initiating movement of the cam follower will be described in greater detail below.

As briefly described above, an override cam an adder mechanism is provided in order to permit transition of the pattern cam follower 70 from one pattern to another with relatively rapid movement regardless of the ornamental pattern selected. In order to carry out this purpose, an override or special cam 68 is provided on the cam stack but is spaced above the pattern cams 66*a – g*. As seen in FIG. 1, the override cam is formed with alternate high cam lobes which are higher than any of the cam lobes of the pattern cams and with alternate low cam stations which are lower than any of the lowest cam stations of the pattern cams. An override or special cam follower 96 is supported on adder shaft 72 for movement along the axis of the shaft and for pivotal movement relative thereto much in the same manner as pattern cam follower 70 and has associated therewith an override adder mechanism comprising an adder element 98 and an adder element 100 which move in much the same manner as the adder mechanism for selecting patterns as described above. The adder element 100 is connected to a link member 102 by a pin 104 disposed in a slot 106 which link member 102 is connected to a solenoid 108 and is spring biased away from the solenoid 108 by a spring 110. The override adder functions in much the same manner as the pattern adder mechanism.

The purpose and function of the override adder mechanism is carried out by initiating operation of the override adder each time a pattern is selected. When the override adder mechanism is in operation, the adder 100 will be moved into camming engagement with the adder 98 to raise the follower 96 and the follower 96 will wait until the override cam is rotated to a position wherein a low station is adjacent the follower so that the follower 96 may move into position in the low station and will then ride up onto one of the high stations of the cam 68. As further seen in FIG. 1, the override cam follower 96 is attached to the wobble plate 44 by means of a spring clip 112 but also in sliding relationship therewith. By this means when the follower reaches the high point on the cam 68 the wobble plate will be rocked to an extreme position carrying with it the pattern cam follower 70 which will then be moved away from the pattern cams 66*a* – *g* so that it may move in a linear direction parallel to the cam shaft axis in response to the adder mechanism to a position adjacent the associated selected pattern cam.

As mentioned above, the pattern cam follower 70 is attached to the wobble plate 44 by means of a spring clip 71 so that its movement will follow the movement of the wobble plate 44 initiated by the override follower 96. In that the high cam point of the override cam is higher than any high point on the pattern cams the pattern cam follower 70 will be moved completely out of the path of any of the high points on the pattern cams so that it will be free to move in its linear path to its selected pattern cam position as mentioned above.

With further reference to FIG. 1 it will be seen that a switch mechansim 114 is provided adjacent the wobble plate 44 and is positioned so that it will be actuated when the wobble plate is in one extreme position of its movement. This extreme position is reached whenever the override follower 96 is at the maximum high point on the override cam 68. When the wobble plate 44 reaches its extreme position it actuates the switch 114 which in turn shuts off the solenoid 108 controlling the adder 100 and the spring 110 will then cause the adder to withdraw thereby permitting the override cam follower to drop out of camming engagement with the override cam 68. The effect of the override adder mechanism therefore is to enable positioning of the pattern cam follower 70 relative to the pattern cams 66*a* – *g*. The operation of the override mechanism is only momentary and after serving its function is turned off so that it no longer has any effect on the mechanism until a new pattern is selected whereupon the override mechanism will again be activated. Thus it will be seen that the override mechanism is energized for only a short period of time relative to the stitching cycle.

The relationship of the pattern adder mechanism and the override adder mechanism collectively called the adder mechanism is a binary one with each pair of adder elements being constructed for initiating movement of the associated cam followers a discrete amount different from each other pair of adder elements. Referring to FIG. 3 a binary selection chart is illustrated therein which lists the distance of follower movement according to the adder selection. For example, it will be seen that if switch 92*a* is depressed solenoid number 108, which is the override solenoid will be the only solenoid activated. In that none of the pattern adders are activated the pattern cam follower 70 will not move along the shaft 72 and it will remain in its lowermost position with reference to FIG. 1 adjacent the pattern cam 66*a*. Thus when the solenoid 108 is shut off due to the extreme movement of the wobble plate 44 to close the switch 114 the cam follower 70 will be disposed in operative engagement with the pattern cam 66*a* so that that particular ornamental pattern will be reproduced during machine operation. As a further example, if switch 92*e* is depressed solenoids 88*a*, 88*c* and 108 will be activated for initiating movement of the pattern cam follower 70 along the adder shaft a distance of 0.500 inches to place the pattern cam follower 70 adjacent patterm cam 66*e*. The arrangement and construction of the adder mechanism is such that, in the preferred embodiment, actuation of solenoid 88*a* for initiating movement of adder element 76*a* into engagement with adder element 74*a* will cause total movement of the pattern cam follower of 0.125 inches, actuation of solenoid 88*b* for initiation of movement of adder 76*b* will cause movement of pattern cam follower 70 0.250 inches, actuation of solenoid 88*c* for initiation of movement of adder 76*c* will cause movement of pattern cam follower 70 0.375 inches and actuation of solenoid 108 for the override mechanism will cause the adder 100 to initiate movement of the override cam follower a distance of 0.125 inches. Thus it will be seen that individual or combinations of solenoids may be used to bring about increments of movement of the pattern cam follower distances as illustrated in the chart of FIG. 3. It will also be seen that the pattern cam follower can be selectively moved to a position for association with a desired pattern cam 66*a* – *g* due to the actuation of individual pairs of adders or combinations thereof. It will be appreciated that more or less pairs of adders can be provided to bring about other combinations for selecting differing numbers of pattern cams.

FIG. 4 represents an example of a circuit diagram which may be used with the pattern selection mechanism of the invention. The selection switches are illustrated at 92*a* – 92*g* as being push button type switches wherein when any one of the switches is depressed the other switches will be reset to an open position. An example of the operation of the circuit is as follows: when a switch 92*a* is depressed a circuit will be completed through line 118 to line 120 connected to a normally closed relay type switch 116 to which is connected to line 122, connected in turn to the solenoid 108. The circuit is completed through a line 124 which is represented as +24 volts connected to a source of power to complete the circuit through power line 126 having a −24 volts potential. A suitable power source, not illustrated, it provided for supplying 24 volts to the selection system and may comprise a step down transformer connected to the typical 110 volt power source for the machine.

As explained above, in relation to the chart illustrated in FIG. 3, when the switch 92*a* is depressed only the solenoid 108 is activated to position the override cam follower 96 adjacent the override cam 68 and as a result the pattern cam follower 70 is not elevated by the pattern adder mechanism or moved to a position beyond the first pattern cam 66*a*. As also explained above, when the override cam follower 96 reaches a high point of the override cam 68 a momentary switch represented at 114 will be closed which then connects the line 128 leading from line 118 to the relay switch 116 and energizes the relay to an open position. The opening of the relay switch 116 will then open the circuit to the override solenoid 108 and disconnect the same so that the override adder mechanism will no longer elevate the override cam follower 96 to a position for operable engagement with the override cam 68. The operation of the other switches 92*b* – 92*g* is similar to that of switch 92*a* in that each time one of these latter switches is actuated the solenoid 108 will be actuated for initiating action of the override adder as well as the combination of pattern adders in accordance with the binary selection chart of FIG. 3. Further operation of each of the other switches will be obvious from the circuit diagram.

It will be apparent from the above description that a novel and improved electromechanical pattern selection system is provided for a sewing machine capable of producing ornamental patterns. The system includes an adder mechanism wherein movement of the components thereof is very limited thus reducing any problem of noise factor and wear and tear on the components of the adder mechanism. Further it will be seen that the selection system of the invention can be adapted to a standard mechanical pattern cam type sewing machine by merely replacing the mechanical selection system with the novel electromechanical selection system of the invention. While the invention has been described in its preferred embodiment, it will be obvious to those skilled in the art that various modifications and changes may be made therein without departing from the spirit and scope of the invention as defined in the appended claims.

Having thus described the nature of the invention, what we claim here is:

1. In a sewing machine having stitch forming instrumentalities, mechanism in said sewing machine responsive to pattern information for regulating at least one of said stitch forming instrumentalities including, a plurality of aligned pattern cams each carrying pattern information, pattern cam follower means including a single cam follower for selectively sensing the pattern information from said pattern cams and for regulating the stitch forming instrumentalities, adder means operably connected to said cam follower means for selectively associating said pattern cam follower means with a pattern cam, and electric switch means for selecting individual patterns of stitches, said switch means being connected to said adder means for initiating association of said pattern cam follower means with a pattern cam carrying pattern information corresponding to the selection of said switch means.

2. In a sewing machine as recited in claim 1 wherein said adder means includes a plurality of relatively movable slide members arranged in a binary relationship.

3. In a sewing machine as recited in claim 1 further comprising override means operatively associated with said pattern cam follower means and including an override cam and an override cam follower disposed for cooperation with said override cam and said override cam follower being responsive to actuation of said adder means for enabling movement said pattern cam follower means to a position for operative engagement with a pattern cam.

4. In a sewing machine as recited in claim 3 wherein said adder means includes a plurality of relatively movable slide members arranged in a binary relationship, a first group of slide members being disposed on a shaft with said pattern cam follower means for relative movement along said shaft, and a second group of slide members being supported for movement in a direction perpendicular to the axis of said shaft and for camming engagement with the slide members of said first group such that the slide members of said first group and said pattern cam follower means will be moved along said shaft in accordance with the selection and movement of the slide members of said second group.

5. In a sewing machine as recited in claim 4 wherein said slide members of each group have a camming surface disposed for operative engagement with a camming surface on a slide member of the other group for initiating movement of the slide members of said first group along said shaft.

6. In a sewing machine as recited in claim 5 wherein each slide member of said first group is paired for cooperation with a slide member of said second group and the relationship of the camming surfaces of each pair of slide members being different that the relationship of each other pair of slide members such that the amount of movement of the slide members of said first group and said pattern cam follower along said shaft will be determined in accordance with selective actuation of at least one pair of said slide members.

7. In a sewing machine as recited in claim 6 further comprising means for initiating relative movement between the slide member of at least one selected pair of said slide members for bringing said slide members of each said pair into camming engagement.

8. In a sewing machine as recited in claim 7 wherein said means for initiating relative movement between the slide members of at least one selected pair of said slide members includes electric motor means operably connected to the slide members of said second group for initiating movement of said slide members of said second group in and out of camming engagement with the slide members of said first group.

9. In a sewing machine as recited in claim 8 wherein said electric motor means includes a plurality of individual electric motors each connected to a slide member of said second group and said electric switch means being connected to said electric motors for selective actuation of at least one of said electric motors at a time.

10. In a sewing machine as recited in claim 9 wherein said electric switch means includes a plurality of individual electric switches each representing a pattern on a corresponding pattern cam, and each said electric switch being connected to said electric motors for selective actuation in accordance with the pattern represented by said electric switch.

11. In a sewing machine having stitch forming instrumentalities, mechanism in said sewing machine responsive to pattern information for regulating at least one of said stitch forming instrumentalities including, a plurality of aligned pattern cams with each said cam carrying pattern information, a pattern follower mechanism including a single pattern cam follower for selectively sensing pattern information from any one of said pattern cams and for transmitting pattern information to said one of said stitch forming instrumentalities, and electric motor means responsive to operator influenced switch means and operative for permitting movement of said cam follower to a non-operative position with respect to said stitch forming instrumentalities.

12. In a sewing machine as recited in claim 11 wherein said pattern cam follower is movable relative to said plurality of pattern cams for selective association therewith.

13. In a sewing machine as recited in claim 12 wherein said electric motor means is operative for initiating removal of said pattern cam follower from sensing relationship with said pattern cams for permitting selective movement of said pattern cam follower from one pattern cam to another pattern cam.

14. In a sewing machine as recited in claim 13 further comprising electric switch means connected to said electric motor means including a first switch means for activating said electric motor means for initiating removal of said pattern cam follower and second switch means for deactivating said electric motor means.

15. In a sewing machine as recited in claim 14 further comprising operator influenced pattern selection means for selecting a pattern carried by said aligned pattern cams and said first switch means being operatively connected with said pattern selection means.

16. In a sewing machine having stitch forming instrumentalities, mechanism in said sewing machine responsive to pattern information for regulating at least one of said stitch forming instrumentalities including, a plurality of aligned pattern cams each carrying distinctive pattern information, a pattern follower mechanism including a single pattern cam follower for sensing pattern information from any one of said pattern cams and for transmitting pattern information to said one of said stitch forming instrumentalities, said pattern cam follower being movable relative to said plurality of pattern cams for selective association therewith, an electrically influenced pattern selection mechanism including electric motor means operatively connected to said cam follower for removing said cam follower from operative engagement with said pattern cams, an operator influenced selector area, switch means operatively associated with said electric motor means and said operator influenced selector area, said switch means operative in response to an operator influenced selection of said selector area for initiating operation of said electric motor means thereby permitting movement of said cam follower for selective association with said plurality of aligned pattern cams.

* * * * *